United States Patent [19]

Brand et al.

[11] Patent Number: 4,520,841

[45] Date of Patent: Jun. 4, 1985

[54] FOUR-WAY VALVE

[76] Inventors: Glen Brand; Timmy L. Chew, both of 2332 S. 25th St., Omaha, Nebr. 68105

[21] Appl. No.: 565,662

[22] Filed: Dec. 27, 1983

[51] Int. Cl.[3] ..... F15B 13/04

[52] U.S. Cl. ..... 137/270; 137/625.68; 137/596

[58] Field of Search ..... 137/269, 270, 625.68, 137/625.69, 596; 91/463

[56] References Cited

U.S. PATENT DOCUMENTS

| | | | |
|---|---|---|---|
| 3,774,635 | 11/1973 | Farrell | 137/625.68 X |
| 3,985,153 | 8/1974 | Thomas | 137/596 |
| 4,117,862 | 10/1978 | Qureshi | 137/625.68 X |
| 4,187,877 | 2/1980 | Hodgson | 137/625.68 X |

*Primary Examiner*—Alan Cohan

*Attorney, Agent, or Firm*—Henderson & Sturm

[57] ABSTRACT

A four-way valve with a built-in flow control function which is convertible between a two port meter-in mode and a two port meter-out mode; and, alternatively, from a two port meter-out mode to a three port meter-in mode.

3 Claims, 8 Drawing Figures

FOUR-WAY VALVE

TECHNICAL FIELD

The present invention relates to a four way valve with a built in flow control function which is convertible between a two port meter in mode and a two port meter out mode; and, alternatively between a two port meter-out mode and a three port meter-in mode.

BACKGROUND ART

In a hydraulically controlled device such as a hydraulically driven vehicle, it is well known that a four-way valve is used to select forward and reverse directions and control speed. Using a meter-in version of such four-way valve, it is no problem to maintain the speed of such device on the level or uphill, but when going downhill, inertia and gravity will often cause such vehicle to go faster than desired, so that excessive braking is needed under such circumstances. Using a two port meter-out four-way valve, instead of a two port meter-in valve will, however, permit the user to control downhill speed, as well as level and uphill speed, by use of a four-way, two port meter-out valve.

There are of course many other uses for four-way valves, and, depending upon the desired use, such valves may need to be structurally different. For example, in U.S. Pat. No. 3,985,153 to Thomas a four-way two port meter-in valve is shown having an inlet port and a pair of active control ports for use with a fixed volume pump, whereby the flow from the pump goes to one action port and exhausts out the other active port, while at the same time having internal flow control spools for maintaining a constant pressure differential between the pressure in the fluid inlet passage and the pressure supplied to the active port being supplied. In the Thomas patent, the importance of having a steady controlled fluid flow and the desirability of incorporating the pressure compensating valve within the four-way valve is explained in detail.

Because of the need for various types of pressure compensated four-way valves, suppliers of such valves are required to stock the various valves needed from time to time by their customers. Consequently, there is a need for four-way valves which are convertible from one version to another, whereby a supplier can have one valve structure in stock, which can be supplied as is to purchaser if one type four-way valve is desired, or quickly converted to another type of four-way valve if such other type of valve is desired. Such valve structures allow the supplier to have less inventory on hand, thereby lowering his inventory costs, while at the same time having in stock the valves that such supplier's customers are likely to want.

DISCLOSURE OF THE INVENTION

The present invention relates to a four-way valve with a built in flow control function which is convertible between a two port meter-in mode and a two port meter-out mode; and, alternatively, between a two port meter-out mode and a three port meter-in mode.

An object of the present invention is to provide an improved four-way valve with a built-in flow control function.

Another object of the invention is to provide an improved four-way, two port flow control valve with a flow control function for use in combination with pressure compensated pump systems.

A further object of the invention is to provide a basic four-way valve with a built in flow control function which is easily convertible between a two port meter-in version and a two port meter-out version.

A still further object of the invention is to provide a basic four-way valve which is easily convertible between a three port meter-in version and a two port meter-out version.

Other objects, advantages and novel features of the present invention will become apparent from the following description of the best mode for carrying out this invention.

BEST MODE FOR CARRYING OUT THE INVENTION

Figure 1:
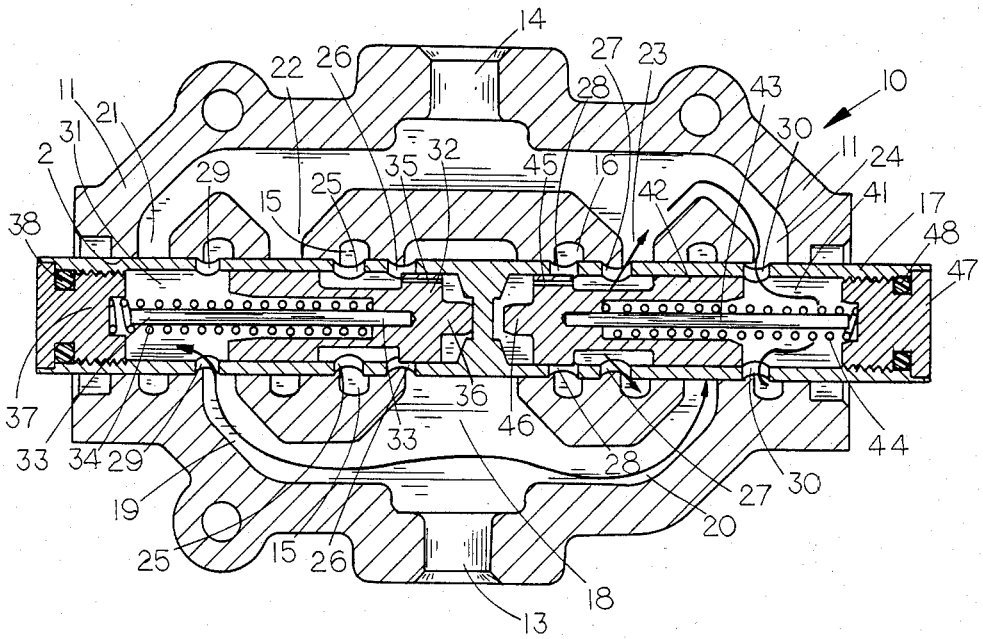
FIG. 1 shows a cross-sectional view of a two port meter-out version of the present invention shown in one of two active positions.
Figure 2:
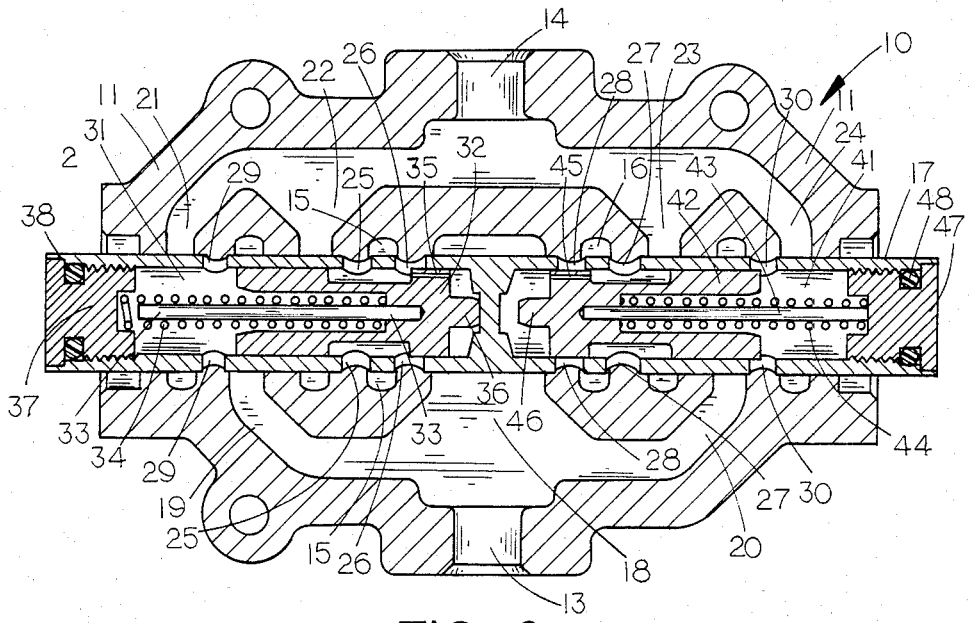
FIG. 2 is a cross-sectional view of such two port meter-out valve shown in FIG. 1, but shown in a neutral position.

Referring now to the drawings wherein like reference numerals designate identical or corresponding parts throughout the several views, FIG. 1 shows a four-way valve (10) constructed in accordance with the present invention. The four-way valve (10) as shown in FIGS. 1 and 2 is a two port meter-out valve for use in pressure compensated pumping systems. For example, in the neutral position, as shown in FIG. 2, there is no flow out of the valve; and, because it is used in a pressure compensated pumping system, the pumping system will shut down to reduce the flow supply to zero in such event, whereas, if a fixed volume pumping system were to be used, then the valve of FIG. 1 would have to be modified in order to allow all of the fixed volume output of the pump to flow back to the supply tank in a neutral position of the valve (FIG. 2).

The valve (10) of FIGS. 1 and 2 has a valve body (11) with a central bore (12) extending therethrough for forming an opening in such valve body (10). An inlet port (13) is formed in the valve body (11) and is in fluid communication with a supply of fluid from a pressure compensated pumping system (not shown).

An outlet port (14) is also formed in the valve body (11) and is in fluid communication with a fluid supply tank (not shown). A first active port (15) is also disposed in the valve body (10) and can be connected, by way of example only, to a one side of a fluid motor, and this first active port (15) is in fluid communication with the opening (12) in the valve body for reasons which will be explained below.

A second active port (16) is also formed in the valve body (11) and leads to the other side of hydraulic motor, for example, or whatever other hydraulic device is being controlled. And this second active port (16) is in fluid communication also with the opening (12) in the valve body (11).

A valve member (17) is slidably disposed in the opening (12) in the valve body (11) and is selectively movable between first and second active positions, the first of which being shown in FIG. 1, and to a third neutral position which is shown in FIG. 2.

A first inlet passage (18) is disposed in the valve body (11) and leads the inlet port (13) to the opening (12) in the valve body (11). A second inlet passage (19) is also disposed in the valve body (11) and leads from the inlet port (13) to the opening (12) in the valve body (11). A third inlet passage (20) is disposed in the valve body (11) and leads from the inlet port (13) to the opening (12).

A first outlet passage (21) in the valve body (11) leads from the opening (12) to the outlet port (14); a second outlet passage (22) leads from the opening (12) to the outlet port (14) in the valve body (11); a third outlet passage (23) leads from an opening (12) to the outlet port (14) in the valve body (11); and a fourth outlet passage (24) leads from the opening (12) to the outlet port (14) in the valve body (11).

First passageways (25), (26); second passageways (27), (28); third passageways (29); and fourth passageways (30) are formed in the valve member (17) for selective communication with the above described inlet and outlet passageways in the valve body as will be discussed below.

The first passageway (25), (26) in the valve member (17) is in fluid communication with the first inlet passage (18) in the valve body (11) and with the first active port (15) in a first active position of the valve member (17). The first passageway (25) (26) in the valve member is in fluid communication with the first active port (15) and with the second outlet passageway (22) in the valve body (11) in the second active position of valve member (17).

Referring again to FIG. 1, second passage (27), (28) of valve member (17) is in fluid communication with second active port (16) and with the third outlet passage (23) in the valve body (11) in the first active position of the valve member (17) as shown in FIG. 1, and the second passageway (27), (28) in valve member (17) is in fluid communication with the first inlet passage (18) in the valve body (11) and with the second active port (16) in the second active position of the valve member (17), which second active position would be when the valve body (17) is moved to the right from the FIG. 2 position thereof as far as it has been moved to the left in the FIG. 1 position.

The third passageway (29) in the valve member (17) is in fluid communication with the second inlet passage (19) in the valve body in the first active position of the valve member and the third passageway (29) in the valve member is in fluid communication with the first outlet passage (21) in the valve body in a second active position of the valve member (17). The fourth passageway (30) in the valve member (17) is in fluid communication with the fourth outlet passage (14) in the valve body in the first active position of the valve member and this fourth passageway (30) in the valve member is in fluid communication with the third inlet passage (20) in the valve member in the second active position of such valve (17).

A first chamber (31) is formed in one end of the valve member (31) and this first chamber (31) is fluidly connected to the first passageways (25), (26) and third passageway (29) of the valve members (17). A second chamber (41) in the other end of the valve member (17) is fluidly connected to the second passageways (27), (28) and fourth passageway (30) in the valve member (17).

A first fluid pressure compensating spool (32) is disposed in first chamber (31) of valve member (17) for controlling the flow out through the first passageway (25), (26) when such valve member (17) is in the first active position shown in FIG. 1. The first pressure compensating spool (32) is biased by a spring (34), which is disposed around a post (33), in this meter-out mode shown in FIGS. 1 and 2. Consequently, when the valve (10) is used to supply the first active port (15), for example as shown in FIG. 1, the fluid from a pressure compensated pumping system would enter the inlet (13) and travel through passageway (18), through opening (26) to the inside of the valve member (17) and then through the opening (25) to the first active port (15) and on to the hydraulic device or motor being supplied with fluid. At the same time this is occurring, the supply side pressure from inlet port (13) is supplied into the opening (31) and this pressure is exerted against the left side of the valve member (32). Also at the same time, the pressure being supplied to the first active port (15) is supplied to the other side of the spool (32) because of the opening (35) which transmits this pressure through the spool (32).

At the same time that flow of fluid is allowed to enter the first active port (15), and is adjusted through the opening (26) by means of positioning the valve member (17), the flow out of the other active port (16) is controlled manually by movement of the valve (17) to move the passageway (27) to form a variable orifice between the passageway (27) and the outlet passage (23), as shown in FIG. 1. At the same time, substantially the outlet pressure at (14) is supplied to the chamber (41) to exert such a pressure on the right side of the valve spool (42) as shown in FIG. 1. At the same time, the outlet pressure at (15), where it passes by the spool (42), will tend to be transmitted back to the opening (45) in the spool (42), to the left side of the spool (42) as shown in FIG. 1. If the pressure of the fluid coming out of the outlet (16) increases quickly, then such increase of pressure will be transmitted on the left side of the spool (42) causing such spool (42) to move to the right and reduce the flow through openings (28), and if the pressure at the exhaust port (14) tends to drop, then the pressure on the right side of the spool (41) will tend to be greater than the pressure on the left side of spool (42) and the spool (42) will move to the left and allow more flow out of exhaust port (16). As a result, the valve (42) will prevent dramatic surges of fluid flow and thereby is very useful in situations referred to in the background art section of this application; for example, if when hydraulically driven vehicle is going downhill, the speed thereof can be easily controlled using this valve (10) of FIGS. 1 and 2 by adjusting the variable orifice formed between the outlet passageway (27) and the outlet passage (23), and at the same time this flow will be controlled in a very steady fashion because of the flow control valve (42) which will prevent rapid fluctuations of the pressure exiting from the exhaust port (16).

It will readily be understood to those skilled in this art that when the valve shown in FIG. 1 is moved to the second active position thereof, whereby the second active port (16) is supplied with pressure and the first active port (15) is exhausting, the meter-out control will reside at the first active port (15) whereby the variable orifice is manually controlled out between the passageway (25) and the outlet passage (22) by manually positioning the position of valve member (17) and the automatic metering to prevent fluctuations in flow will constitute the spool (32) operating substantially in the fashion described above with respect to the spool (42) to automatically control the flow through passageway (26) from active port (15).

Figure 3:
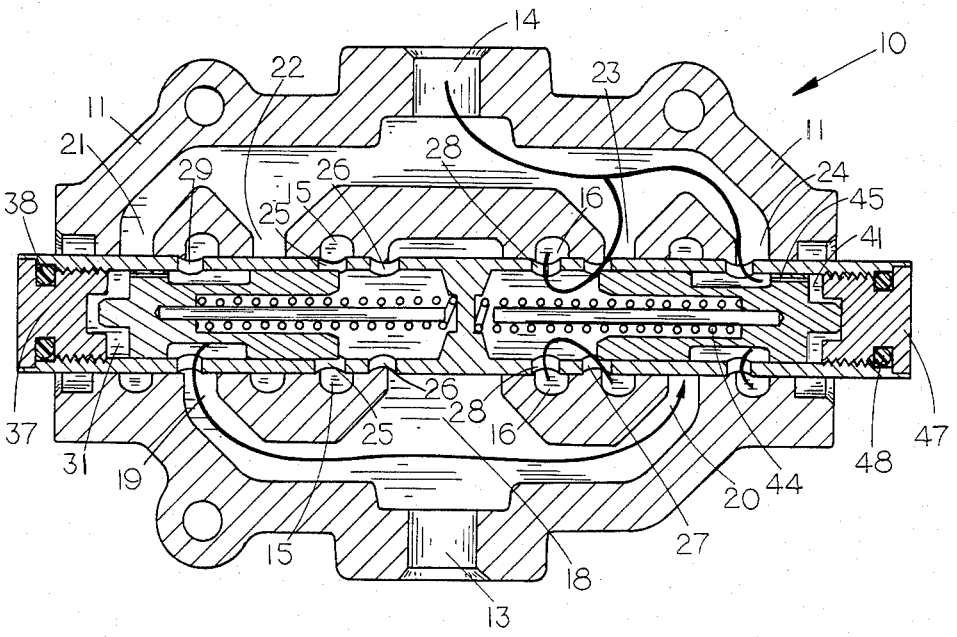
FIG. 3 is a cross-sectional view of the present invention shown in a two port meter-in mode and in an active position thereof.
Figure 4:
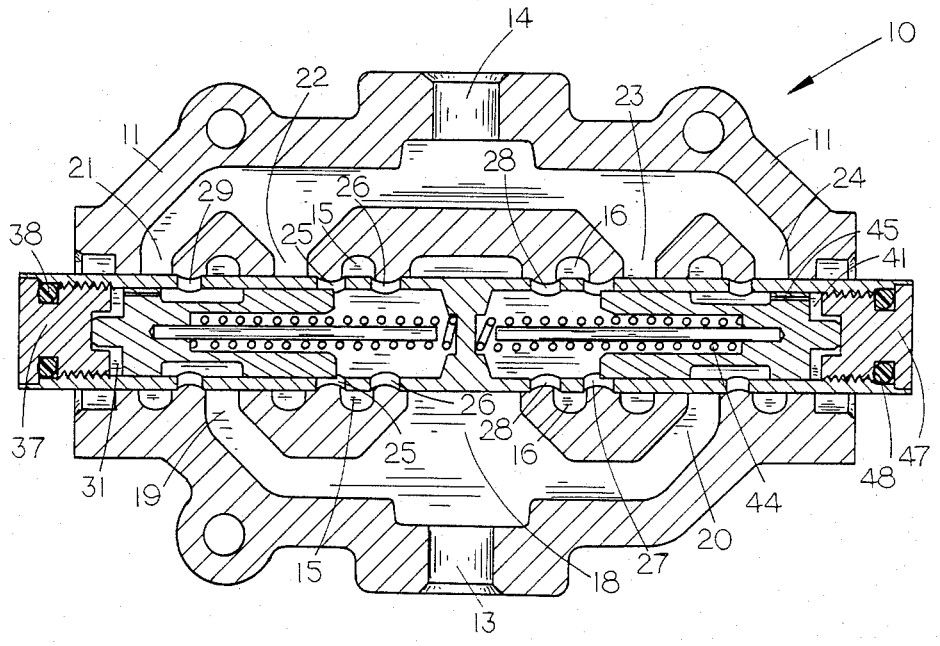
FIG. 4 shows a cross-sectional view of the two port meter-in valve of FIG. 3 in a neutral position thereof.

Referring now to FIGS. 3 and 4, it is noted that the basic valve structure described above is essentially the same as shown as FIGS. 1 and 2, except that the spools (32) and (42) have been reversed, by threadably removing the end plugs (37) and (47) and physically reversing the valve members (32) and (42) along with the respective springs (34) and posts (33). The result of this conversion from FIGS. 1 and 2 to FIG. 3 is that the valve (10) has been converted to a two port meter-in version from the two port meter-out version as shown in FIGS. 1 and 2. Consequently, in operation, the valve (17) shown in FIGS. 3 and 4 can be movable between a first active position shown in FIG. 3 and a second active position, whereby the valve member (17) is moved to the right approximately as much as it has been moved to the left in FIG. 3 from a neutral position shown in FIG. 4.

In FIG. 4, all of the passageways are blocked off when such valve (17) is in central, netural, position for use in pressure compensated pumping systems. As is well known to those skilled in this art, there are certain times when a two port meter-in type of valve is desirable rather than metering the flow out of such a four-way valve system.

In FIG. 3, the flow from the pressure compensating pumping system (not shown) enters the inlet port (13) to passageway (18) and is metered through the openings (26), depending upon the position of valve member (17). Then the flow from thereon is automatically metered through the openings (25) and into the first active port (15) while at the same time the valve (31) automatically prevents surges or drops in pressure, depending upon the pressure on each side of the valve spool (31). For example, in FIG. 3, it is noted that the flow into the inlet port (13) is generally supplied to the left side of the valve spool (31) through the passageway (35) in such spool (31) and that the pressure on the other side of the valve spool (31) depends on the pressure going through the variable orifice (26). At the same time that the flow is being metered into the first active port (15), the flow out of the exhaust port (16) is permitted to exit through passageway (27), passage (26) and on to the outport port (14). In this position of the valve, the pressure on each side of the spool (42) is fairly well equalized so that the spring (44) tends to maintain such spool (42) to the right as shown in FIG. 3, thereby not affecting the flow out of the exhaust port (16).

However, when the valve (17) shown in FIGS. 3 and 4 is moved to the other active position thereof, i.e., to the right from the position shown in FIG. 4, then the metering-in function to the second active port (16) will be adjusted manually through the passageways (28) and flow and pressure fluctuations will substantially be prevented by means of such automatic metering between the valve member (42) and passageway opening (27).

Accordingly, it will be readily appreciated that a supplier or potential user of the structure shown in FIGS. 1–4 can have one structure which, by simple conversion, convert it between a two port meter-out structure and a two port meter-in structure. This feature is particularly valuable to a supplier of valves because it means that inventories of such valves can effectively be cut in half by having one structure in stock while such supplier is ready to supply either type of valve, depending upon the customer's wishes.

Figure 5:
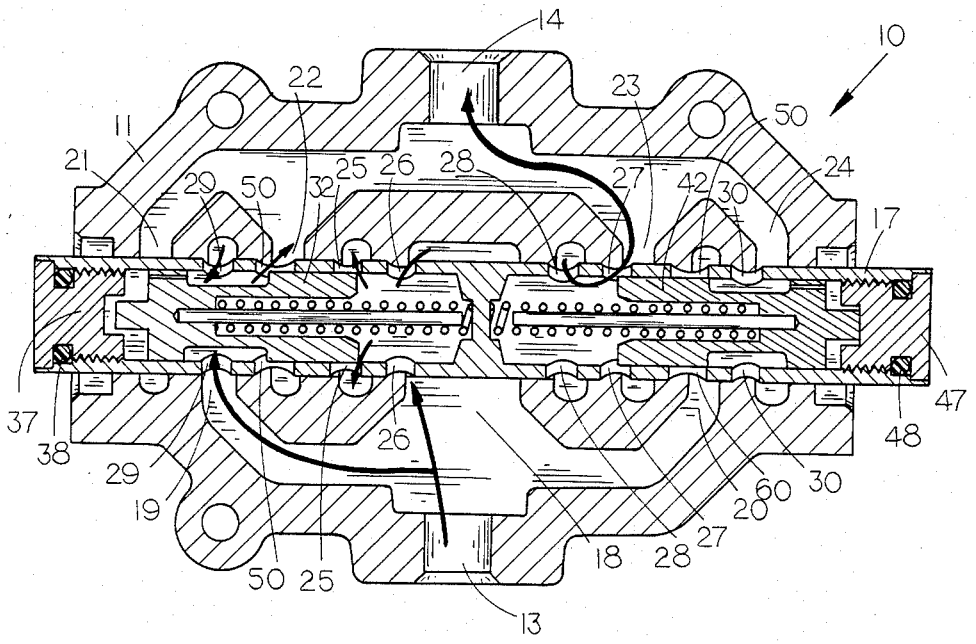
FIG. 5 shows a cross-sectional view of the present invention in a three port meter-in mode and in one of two active positions thereof.
Figure 6:
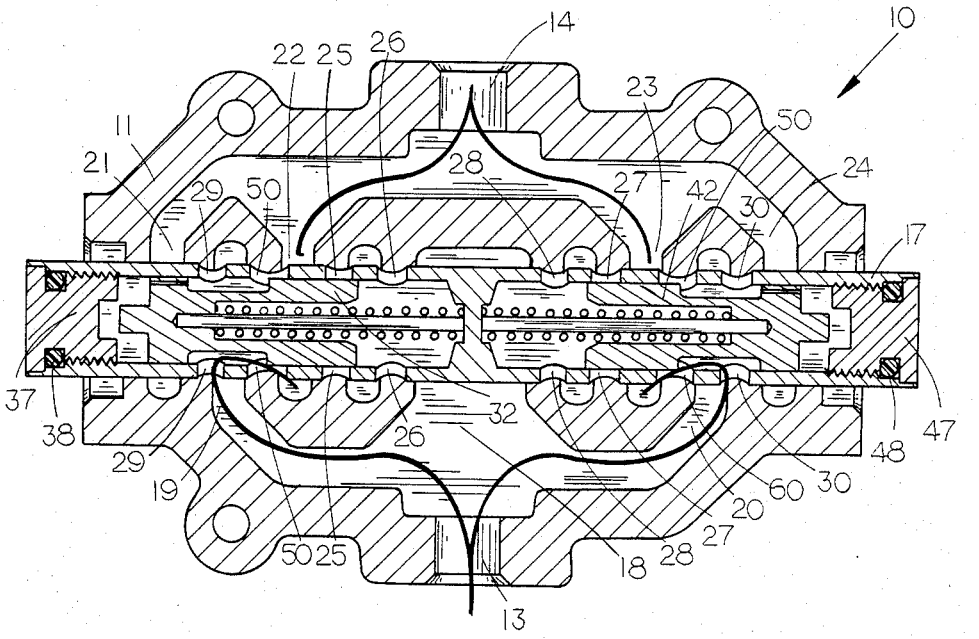
FIG. 6 shows a cross-sectional view of the three port meter-in valve of FIG. 5 in a neutral position thereof.
Figure 7:
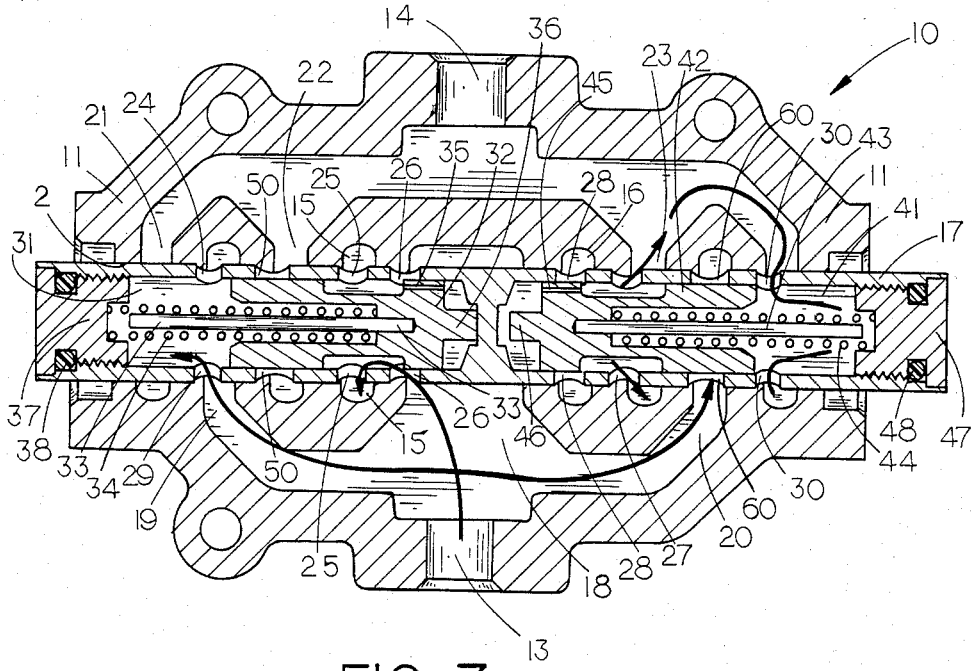
FIG. 7 shows a cross-sectional view of the present invention in a two port meter-out mode and in one of two active positions thereof.
Figure 8:
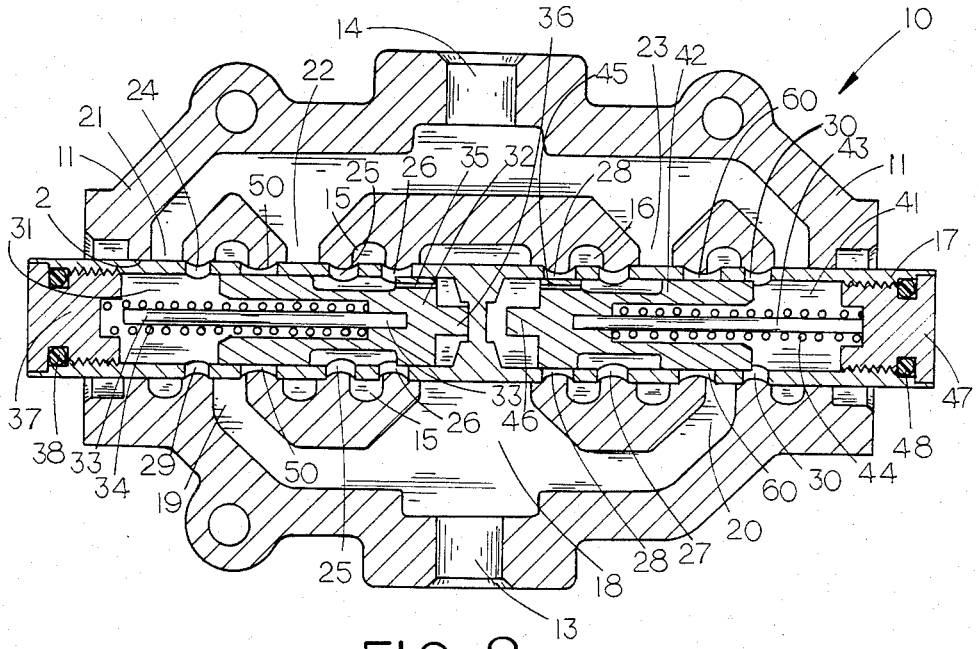
FIG. 8 shows a cross-sectional of the two port meter-out valve of FIG. 7 in a neutral position thereof.

Referring now to FIGS. 5 and 6, it is noted that the four-way valve shown therein is substantially identical to the valve structure in FIGS. 3 and 4 except that it has additional passageways (50) and (60) in the valve member (17). These additional passageways (50) and (60) permit the valve structure to function either as a three port meter-in valve, as shown in FIGS. 5 and 6, or a two port meter-out valve as shown in FIGS. 7 and 8. In FIGS. 7 and 8, for example, when the valve spools (32) and (42) are reversed from the position as shown in FIGS. 5 and 6, the openings (50) and (60) are substantially blocked by the lands of the spools (32) and (42) and thereby are of no effect in the FIGS. 7 and 8 embodiment, but the presence of such passageways (50) and (60) allow such valve structures shown in FIGS. 5–8 to be fully adaptable between a three port meter-in valve, as shown in FIGS. 5 and 6, and a two port meter-out valve, as shown in FIGS. 7 and 8.

Referring again to FIGS. 5 and 6, it is noted that a three port meter-in valve is particularly useful in a fixed volume pumping system, whereby even though a volume less than the volume being pumped is used at any one time in the active ports, the excess flow is allowed to flow back to the tank. For example, flow from such fixed volume pumping system enters the inlet port (13) to the inlet passage (18) and from there enters through the passageway (26) when valve member (17) is in the first active position thereof as shown in FIG. 5. Then the flow proceeds on from the passageway (26) through passageway (25) and such flow through passageway (25) is metered by the spool valve (32) in the fashion referred to in the FIG. 3 embodiment, whereby the relative pressure on each respective side of the spool (32) determines the relative position thereof with respect to the opening (25), for the purpose of preventing surges or drops of pressure and flow and substantially modulates the flow therethrough and into the first active port (15). The difference between the FIG. 5 embodiment and the FIG. 3 embodiment resides in the addition of the passageways (50) and (60) in the valve body (17), in the FIG. 5 embodiment and, as shown in FIG. 5, the excess flow from a fixed volume pumping system is allowed to pass through the third port or bypass port (50) and out to the exhaust port (14).

At the same time that the flow is metered manually, by the movement of the valve (17), through passageway (26), it is metered automatically through the opening (25) by means of valve spool (32). The flow from the second active port (16) is allowed to flow out through the passageways (26) and (27) to the outlet (14) substantially unimpeded. As in the two port meter-in version of FIG. 3, the spool (42) will have substantially the same pressure applied to each side thereof in this position and the spring (44) will therefore hold the spool (42) substantially in the position shown in FIG. 5 when the valve (17) is metering fluid into first active port (15).

When the valve of FIG. 5 is moved to the neutral position as shown in FIG. 6, then the passageways (50) and (60) permit flow out to the exhaust port (14), substantially unimpeded as indicated by the flow arrows in FIG. 6. It is important to note, however, that in the neutral position shown in FIG. 6, the inlet pressure will substantially be supplied to the left hand side of the spool (32) and to the right side of the spool (42) to overcome the bias of the springs (34) and (44) to thereby hold the spools (32) and (42) so that this bypass function will occur under such conditions.

Referring now to FIGS. 7 and 8, it is noted that the function of FIGS. 7 and 8 embodiments are identical to the structure referred to and described above with respect to the structure of FIGS. 1 and 2. The purpose of showing the additional openings or passageways (50) and (60) in FIGS. 7 and 8 is to illustrate the point that such structure is identical to the structure shown in FIGS. 5 and 6, except that the spools (32) and (42), and their accompanying biasing structure, have been reversed. It will therefore be appreciated to those skilled in this art that with this identical structure as shown in FIGS. 5–8, a supplier of valves can have one such structure on the shelf, and be ready and able to supply either a three port meter-in four-way valve or a two port meter-out version of such valve to a potential customer, while at the same time reducing the supplier's inventory costs by fifty percent.

Obviously, many modifications and variations of the present invention are possible in light of the above teachings. It is therefore to be understood that, within the scope of the appended claims, the invention may be practiced otherwise than as specifically described.

I claim:

1. A four way valve for use in pressure compensated pump systems comprising:

a valve body;

bore means for forming an opening in said valve body;

an inlet port in said valve body in fluid communication with a source of supply of fluid;

an outlet port in said valve body in fluid communication with a fluid supply tank;

a first active port in fluid communication with said opening in the valve body;

a second active port in fluid communication with the opening in said valve body;

a valve member disposed in said opening and selectively movable to first and second active positions and a third neutral position;

a first inlet passage in said valve body leading from said inlet port to said opening in said valve body;

a second inlet passage leading from said inlet port to said opening in said valve body;

a third inlet passage leading from said inlet port to said opening in said valve body;

a first outlet passage in said valve body leading from said opening in said valve body to said outlet port;

a second outlet passage leading from said opening in said valve body to said outlet port;

a third outlet passage leading from said opening in said valve body to said outlet port;

a fourth outlet passage leading from said opening in said valve body to said outlet port;

a first passageway formed in said valve member;

a second passageway formed in said valve member;

a third passageway formed in said valve member;

a fourth passageway formed in said valve member;

said first passageway in said valve member being in fluid communication with said first inlet passage in said valve body and said first active port in said first active position of said valve member, said first passageway in said valve member being in fluid communication with said first active port and with said second outlet passage in said valve body in said second active position of said valve member;

said second passage in said valve member being in fluid communication with said second active port and with said third outlet passage in said valve body in said first active position of said valve member, said second passageway in said valve member being in fluid communication with said first inlet passage in said valve body and said second active port in said second active position of said valve member;

said third passageway in said valve member being in fluid communication with said second inlet passage in said valve body in said first active position of said valve member, said third passageway in said valve member being in fluid communication with said first outlet passage in said valve body in said second active position of said valve member; and said fourth passageway in said valve member being in fluid communication with said fourth outlet passage in said valve body in said first active position of said valve member, said fourth passageway in said valve member being in fluid communication with said third inlet passage in said valve body in said second active position of said valve member;

first chamber means for forming a first chamber in one end of said valve member, said first chamber being fluidly connected to said first and third passageways formed in said valve member;

second chamber means for forming a second chamber in the other end of said valve member, said second chamber being fluidly connected to said second and fourth passageways in said valve member;

first fluid pressure compensating means disposed in said first chamber of said valve member for controlling the flow out through said first passageway, said first pressure compensating means, in a meter-out mode being biased to a first position and movable between said first position and a second position, depending upon the relative fluid pressure acting on each end of said first fluid pressure compensating means, the pressure on each end of said first fluid pressure compensating means being the same as the pressure in the inlet port in the first active position of said valve member, said first fluid pressure compensating means tending to be moved from the first position thereof, toward the second position thereof when said valve member is in the second active position thereof, whereby fluid is metered out of said first active port of said valve body, through said first passageway in said valve member, past said first fluid compensating means in said first chamber of said valve member and out the second outlet passage to said outlet port;

second fluid pressure compensating means disposed in said second chamber of said valve member for controlling the flow through said second passageway, said second pressure compensating means being biased to a first position and movable to a second position depending upon the relative fluid pressure acting on each end of said second fluid pressure compensating means, said second fluid pressure compensating means tending to be moved from the first position thereof towards the second position thereof when said valve member is in the first active position thereof, whereby fluid is metered out of said second active port of said valve body, through said second passageway in said valve member, past said second fluid compensating means in said second chamber of said valve member and out the third outlet passage to said outlet port, the pressure on each end of said second fluid pressure compensating means being the same as the pressure in the inlet port in the second active position of said valve member; and wherein none of said passageways in said valve member are in fluid communication with any of said inlet or outlet passageways in said valve body when said valve member is in the neutral position thereof.

2. A four way valve for use in pressure compensated pump systems comprising:

a valve body;

bore means for forming an opening in said valve body;

an inlet port in said valve body in fluid communication with a source of supply of fluid;

an outlet port in said valve body in fluid communication with a fluid supply tank;

a first active port in fluid communication with said opening in the valve body;

a second active port in fluid communication with the opening in said valve body;

a valve member disposed in said opening and selectively movable to first and second active positions and a third neutral position;

a first inlet passage in said valve body leading from said inlet port to said opening in said valve body;

a second inlet passage leading from said inlet port to said opening in said valve body;

a third inlet passage leading from said inlet port to said opening in said valve body;

a first outlet passage in said valve body leading from said opening in said valve body to said outlet port;

a second outlet passage leading from said opening in said valve body to said outlet port;

a third outlet passage leading from said opening in said valve body to said outlet port;

a fourth outlet passage leading from said opening in said valve body to said outlet port;

a first passageway formed in said valve member;

a second passageway formed in said valve member;

a third passageway formed in said valve member;

a fourth passageway formed in said valve member;

said first passageway in said valve member being in fluid communication with said first inlet passage in said valve body and said first active port in said first active position of said valve member, said first passageway in said valve member being in fluid communication with said first active port and with said second outlet passage in said valve body in said second active position of said valve member;

said second passage in said valve member being in fluid communication with said second active port and with said third outlet passage in said valve body in said first active position of said valve member, said second passageway in said valve member being in fluid communication with said first inlet passage in said valve body and said second active port in said second active position of said valve member;

said third passageway in said valve member being in fluid communication with said second inlet passage in said valve body in said first active position of said valve member, said third passageway in said valve member being in fluid communication with said first outlet passage in said valve body in said second active position of said valve member; and said fourth passageway in said valve member being in fluid communication with said fourth outlet passage in said valve body in said first active position of said valve member, said fourth passageway in said valve member being in fluid communication with said third inlet passage in said valve body in said second active position of said valve member;

first chamber means for forming a first chamber in one end of said valve member, said first chamber being fluidly connected to said first and third passageways formed in said valve member;

second chamber means for forming a second chamber in the other end of said valve member, said second chamber being fluidly connected to said second and fourth passageways in said valve member;

first fluid pressure compensating means disposed in said first chamber of said valve member for controlling the flow out through said first passageway said first pressure compensating means, biasing means for biasing said first pressure compensating means to a first position and permitting said first pressure compensating means to be movable between said first position and a second position, in a meter-out mode thereof depending upon the relative fluid pressure acting on each end of said first fluid pressure compensating means, the pressure on each end of said first fluid pressure compensating means being the same as the pressure in the inlet port in the first active position of said valve member, said first fluid pressure compensating means tending to be moved from the first position thereof, towards the second position thereof when said valve member is in the second active position thereof, whereby fluid is metered out of said first active port of said valve body, through said first passageway in said valve member, past said first fluid compensating means in said first chamber of said valve member and out the second outlet passage to said outlet port; and means for permitting said first fluid pressure compensating means to be reversible for use in a meter-in mode for metering flow into said first active port, whereby said biasing means is used to bias said first fluid pressure compensating means to a second position, wherein one end of said fluid pressure compensating means is in fluid communication with the pressure from said supply port and the other end of said fluid pressure compensating means being at a lesser pressure corresponding to the pressure on the downstream side of a variable orifice formed at the juncture of said first passageway in the valve member and the first inlet passage in the valve body whereby the flow from the inlet passage to the first active port will be selectively adjustable and the flow from said first chamber to said first active port will further be automatically metered in proportion to the relative pressure across said variable orifice;

second fluid pressure compensating means disposed in said second chamber of said valve member for controlling the flow through said second passageway, said second pressure compensating means being biased to a first position and movable to a second position depending upon the relative fluid pressure acting on each end of said second fluid pressure compensating means, said second fluid pressure compensating means tending to be moved from the first position thereof towards the second position thereof when said valve member is in the first active position thereof, whereby fluid is metered out of said second active port of said valve body, through said second passageway in said valve member, past said second fluid compensating means in said second chamber of said valve member and out the third outlet passage to said outlet port, the pressure on each end of said second fluid pressure compensating means being the same as the pressure in the inlet port in the second active position of said valve member, and means for permitting said second fluid compensating means to be reversible for use in a meter-in mode for metering flow into said second active port, whereby said biasing means is used to bias said second fluid pressure compensating means to a second position whereby one end of said fluid pressure compensating means is in fluid communication with the pressure from said supply port and the other end of said fluid pressure compensating means is at a lesser pressure corresponding to the pressure on the downstream side of a variable orifice formed at the juncture of said second passageway in the valve member and the first inlet passage in the valve body whereby the flow from the inlet passage to the second active port will be selectively adjustable at said second variable orifice and the flow from said second chamber active port will further be automatically metered in proportion to the relative pressure across said second variable orifice; and wherein none of the passageways in said valve member are in fluid communication with any of said inlet or outlet passages in said valve body when said valve member is in the neutral position thereof.

3. A four way valve for use in a two port meter out mode pump system and convertible to a three port meter in mode in fixed volume pump system comprising:

a valve body;

bore means for forming an opening in said valve body;

an inlet port in said valve body in fluid communication with a source of supply of fluid;

an outlet port in said valve body in fluid communication with a fluid supply tank;

a first active port in fluid communication with said opening in the valve body;

a second active port in fluid communication with the opening in said valve body;

a valve member disposed in said opening and selectively movable to first and second active positions and a third neutral position;

a first inlet passage in said valve body leading from said inlet port to said opening in said valve body;

a second inlet passage leading from said inlet port to said opening in said valve body;

a third inlet passage leading from said inlet port to said opening in said valve body;

a first outlet passage in said valve body leading from said opening in said valve body to said outlet port;

a second outlet passage leading from said opening in said valve body to said outlet port;

a third outlet passage leading from said opening in said valve body to said outlet port;

a fourth outlet passage leading from said opening in said valve body to said outlet port;

a first passageway formed in said valve member;

a second passageway formed in said valve member;

a third passageway formed in said valve member;

a fourth passageway formed in said valve member;

a fifth passageway formed in said valve member;

a sixth passageway formed in said valve member;

said first passageway in said valve member being in fluid communication with said first inlet passage in said valve body and said first active port in said first active position of said valve member, said first passageway in said valve member being in fluid communication with said first active port and with said second outlet passage in said valve body in said second active position of said valve member;

said second passage in said valve member being in fluid communication with said second active port and with said third outlet passage in said valve body in said first active position of said valve member, said second passageway in said valve member being in fluid communication with said first inlet passage in said valve body and said second active port in said second active position of said valve member;

said third passageway in said valve member being in fluid communication with said second inlet passage in said valve body in said first active position of said valve member, said third passageway in said valve member being in fluid communication with said first outlet passage in said valve body in said second active position of said valve member; and said fourth passageway in said valve member being in fluid communication with said fourth outlet passage in said valve body in said first active position of said valve member, said fourth passageway in said valve member being in fluid communication with said third inlet passage in said valve body in said second active position of said valve member;

first chamber means for forming a first chamber in one end of said valve member, said first chamber being fluidly connected to said first and third passageways formed in said valve member;

second chamber means for forming a second chamber in the other end of said valve member, said second chamber being fluidly connected to said second and fourth passageways in said valve member;

first fluid pressure compensating means disposed in said first chamber of said valve member for controlling the flow out through said first passageway, said first pressure compensating means biasing means for biasing said first pressure compensating means to a first position and permitting said first pressure compensating means to be movable between said first position and a second position, in a meter-out mode thereof, depending upon the relative fluid pressure acting on each end of said first fluid pressure compensating means, the pressure on each end of said first fluid pressure compensating means being the same as the pressure in the inlet port in the first active position of said valve member, said first fluid pressure compensating means tending to be moved from the first position thereof, toward the second position thereof, when said valve member is in the second active position thereof, whereby fluid is metered out of said first active port of said valve body, through said first passageway in said valve member, past said first fluid compensating means in said first chamber of said valve member and out the second outlet passage to said outlet port;

second fluid pressure compensating means disposed in said second chamber of said valve member for controlling the flow through said second passageway, said second pressure compensating means being biased to a first position and movable to a second position depending upon the relative fluid pressure acting on each end of said second fluid pressure compensating means, said second fluid pressure compensating means tending to be moved from the first position thereof towards the second position thereof when said valve member is in the first active position thereof, whereby fluid is metered out of said second active port of said valve body, through said second passageway in said valve member, past said second fluid compensating means in said second chamber of said valve member and out the third outlet passage to said outlet port, the pressure on each end of said second fluid pressure compensating means being the same as the pressure in the inlet port in the second active position of said valve member; and wherein none of said passageways in said valve member are in fluid communication with any of the inlet or outlet passages in said valve body when said valve member is in the neutral position of the two port meter-out mode thereof; and, wherein said first fluid pressure compensating means is reversible for use in a three port meter-in mode and is biased to a first position thereof whereby in a first active position of said valve member in the three port meter-in mode;

said first passageway is in fluid communication with said first inlet passage thereby forming an adjustable variable orifice port and said first passageway is further in fluid communication with said first active port; thereby forming an automatically metered port, and wherein said third inlet passageway is in fluid communication with said second inlet passage and with said fourth passageway in said valve body and whereby said fourth passageway is in fluid communication with said second outlet passage, thereby forming a by-pass meter port leading to said outlet port; and wherein said second fluid pressure compensating means is reversible for use in said three port meter-in mode and is biased to a first position thereof whereby in said first active position of said valve member in the three port meter-in mode said second passageway is in fluid communication with said second active port and with said third outlet passage for permitting the fluid in said second active port to exhaust out to said outlet port; and wherein when said second fluid pressure compensating means is reversed for use in a three port meter-in mode and is biased to said first position thereof and when, said valve member is in a second active position of the three port meter-in mode, said second passageway is in fluid communication with said first inlet passage thereby forming a second adjustable variable orifice port and said second passageway is further in fluid communication with said second active port, thereby forming a second automatically metered port, and wherein said fourth inlet passageway is in fluid communication with said third inlet passage and with said fifth passageway in said valve body and whereby said fifth passageway is in fluid communication with said third outlet passage, thereby forming a second by-pass meter port leading to said outlet port; and wherein when said first fluid pressure compensating means is reversed for use in said three port meter-in mode and is biased to said first position thereof in said second active position of said valve member in the three port meter-in mode, said first passageway is in fluid communication with said first active port and with said second outlet passage for permitting the fluid in said first active port to exhaust out to said outlet port.

* * * * *